US007478602B2

(12) United States Patent
Peng

(10) Patent No.: US 7,478,602 B2
(45) Date of Patent: Jan. 20, 2009

(54) FOLD-AWAY GAME TABLE

(76) Inventor: Wen Chih Peng, 10F, No. 192-4, Sanchung Rd. Sec. 3, San Chung City, Taipei (TW)

( * ) Notice: Subject to any disclaimer, the term of this patent is extended or adjusted under 35 U.S.C. 154(b) by 200 days.

(21) Appl. No.: 11/483,349

(22) Filed: Jul. 10, 2006

(65) Prior Publication Data

US 2008/0006185 A1 Jan. 10, 2008

(51) Int. Cl.
*A47B 3/00* (2006.01)

(52) U.S. Cl. ..... 108/131

(58) Field of Classification Search ..... 108/130, 108/131, 132; 248/166, 170, 171, 439, 188.6; 403/122

See application file for complete search history.

(56) References Cited

U.S. PATENT DOCUMENTS 2,622,353 A * 12/1952 Mendelson ..... 38/137
2,683,014 A * 7/1954 Sumen et al. ..... 248/150
3,120,976 A * 2/1964 Van Syoc ..... 297/60
3,483,996 A * 12/1969 Scammon ..... 294/143
3,695,567 A * 10/1972 Weagle ..... 248/188.6
5,070,796 A * 12/1991 Marone et al. ..... 108/124
5,437,298 A * 8/1995 Lin ..... 135/117
D456,632 S * 5/2002 Chang ..... D6/425

OTHER PUBLICATIONS

Ad From UK Magazine of Unknown Origin Showing "BCE Table Sports" Pool Tables.

* cited by examiner

*Primary Examiner*—José V Chen
*Assistant Examiner*—Matthew W Ing
(74) *Attorney, Agent, or Firm*—Frank Marino

(57) ABSTRACT

A game table is disclosed having a support structure including a large normally horizontal tabletop and legs that are adapted to allow the tabletop to be quickly and effortlessly repositioned into a vertical storage position where the legs are disposed parallel to and against the tabletop so that the table occupies less floor area during periods of non-use.

13 Claims, 3 Drawing Sheets

FOLD-AWAY GAME TABLE

FIELD OF THE INVENTION

This invention relates to a game table. More particularly, this invention relates to a game table having a normally horizontal playing surface on the table's top and a table top support system adapted to allow quick and convenient conversion of the table from a playing condition which requires more floor area to a storage condition which requires less floor area. In its preferred embodiment, this invention relates to an air hockey table with a playing surface on the tabletop that can be quickly and effortlessly converted from its normal horizontal playing position to a vertical storage position.

BACKGROUND AND OBJECTS OF THE INVENTION

Many recreational games are played upon a large horizontal tabletop. Many tables are specifically designed to serve as a playing surface for a particular game, which game is played upon the table's top. Typical of these tables and games are pool tables for playing pool, ping-pong tables for playing ping pong, air hockey tables for playing air hockey, and others. Many of these table surfaces are long and wide, and require that the game table occupy much of the floor area in a room.

Numerous game tables of the prior art have attempted to provide a means for converting the table into a more compact configuration for storage in which less floor area is occupied. Generally, such tables allow the tabletop to be repositioned into a vertical orientation to reduce the required floor area. Many well known prior art Ping Pong tables, for example, have a hinged seam in the middle of the tabletop that allows the table to be vertically folded and horizontally compressed so that the table may be moved up against a wall and out of the way. But most game tables are not adaptable to allow the tabletop to be folded.

A British game table supplier by the name of BCE Ltd provides a line of pool tables having two pairs of legs, which are both adapted to be pivoted relative to the tabletop into a configuration wherein the legs are coplanar with the tabletop. One of the leg pairs is a base leg pair having a foot portion which remains on the floor as the tabletop is pivoted upwardly from its normal horizontal playing position to a vertically upright storage position. The second leg pair may then be pivoted downwardly against the tabletop to horizontally compress the table into a tall thin configuration for storage up against a wall. Knobs allow the user to tighten the hinges to avoid having the tabletop inadvertently fall down from this position. While such a storage system does minimize the amount of floor space required during storage, it lacks the convenience and safety of the present invention. Besides the inconvenience of the numerous steps required to convert the table between positions, by requiring that the user must separately fold the second pair of legs after the table has been pivoted to is upright position, it is necessary to convert the table to its storage position in an area of sufficient free space to allow clearance for the outwardly extending second legs. More importantly, if the second legs are not first extended and those knobs fully tightened prior to lowering the tabletop back down for play, the tabletop could collapse dangerously to the floor. And reliance on the proper tightening of the aforementioned knobs to ensure that the table does not accidentally collapse during use is not an acceptable to many users.

It is therefore desirable and an object of the present invention to provide a game table adapted to be quickly and easily converted from its normal playing configuration into a storage configuration in which a minimal amount of floor space is occupied.

Due to the size and weight of tabletops in general, it is an additional object to provide such a game table that allows such conversion to be accomplished safely and effortlessly.

It is a further object to provide such a game table that is positively and safely secured in both configurations.

It is a further object to provide such a table that requires a minimal number of operational steps for the conversion, It is an additional object to provide such a table in which the conversion maintains the levelness of the tabletop when it is returned to its playing configuration after storage.

The above and other objects are addressed by the following embodiment of the present invention.

SUMMARY OF THE INVENTION;

The present invention is a game table having an instant and effortless means for repositioning its tabletop from its normal horizontal playing position to an upwardly directed vertical storage position, in which the table top and legs are automatically pivoted relative to each other during the repositioning into a compact vertical configuration, and in which safe securement into both the playing and storage positions is positive and fool-proof.

A complete appreciation for the various features and advantages of the present invention will be had by those skilled in the appropriate arts upon review of the following complete description of these two most preferred embodiments.

Figure 1:
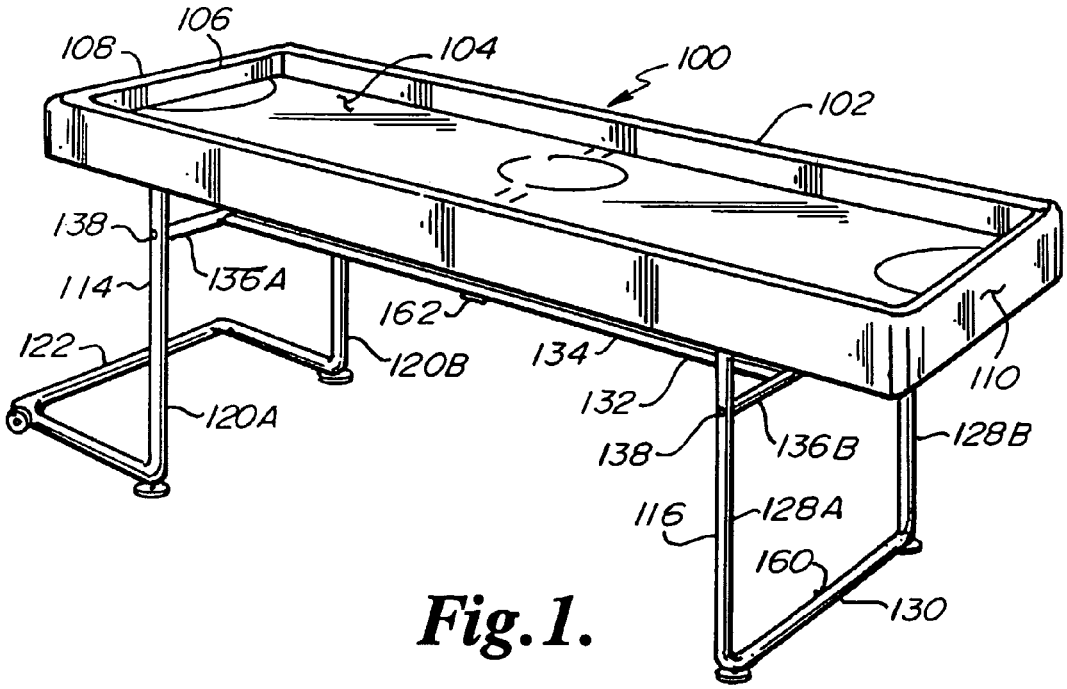
FIG. 1 is a perspective view of an air hockey table in accordance with the preferred embodiment of the invention in its playing configuration.
Figure 2:
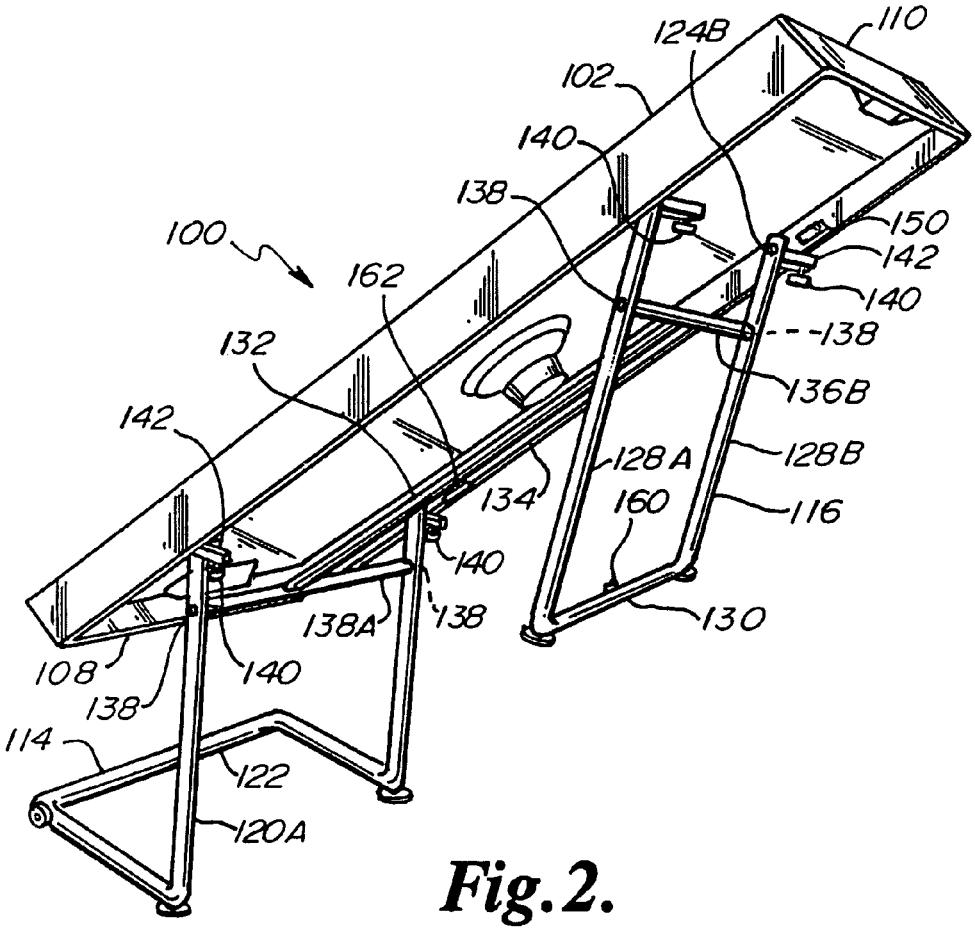
FIG. 2 is a perspective view of the table of FIG 1 being converted between its playing and storage configurations.

DESCRIPTION OF THE PREFERRED EMBODIMENT OF THE INVENTION;

Referring now to the drawings, FIG. 1 through FIG. 5B depict an air hockey table 100 having a tabletop 102 which is adapted with a horizontally disposed playing surface 104. The perimeter of the tabletop includes a peripheral wall 106 to keep the game puck (not shown) on the playing surface and to hide unsightly components adjacent to the underside of the tabletop. A player normally stands at each of the longitudinally opposed ends of the table; first end 108 and second end 110.

The tabletop 102 is supported by two leg assemblies; first leg assembly 114 and second leg assembly 116.

First leg assembly 114 comprises a pair of upright support columns 120A and 120B, rigidly connected together by U-shaped foot member 122. Both support columns and the foot member are preferably made of hollow steel tubing, and the columns and foot member may be made of one piece of tubing bent at each corner or it may be made of separate sections of tubing welded together at the corners.

Figure 3:
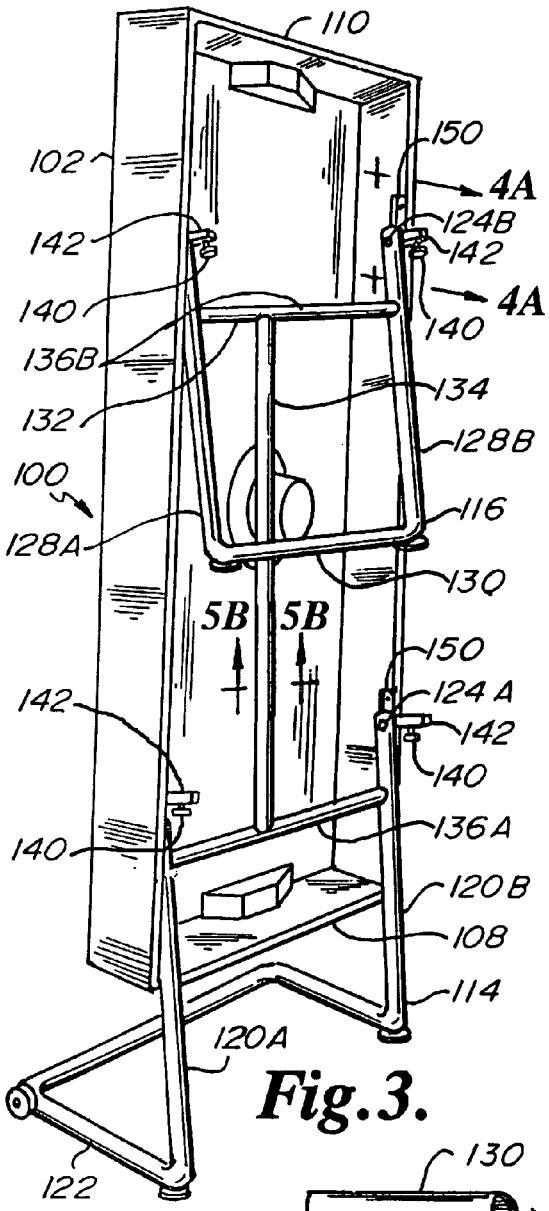
FIG. 3 is a perspective view of the table of FIG 1 in its storage configuration.

First leg assembly 114 is pivotally connected to the underside of tabletop 102 near to the tabletop's first end 108 by hinge pins 124A, allowing tabletop 102 to be pivoted relative to first leg assembly 114 from the tabletop's normal playing position shown in FIG. 1 to the tabletop's upright storage position shown in FIG. 3.

When tabletop 102 is in the playing position of FIG. 1, the first leg assembly 114 supports the tabletop's first end 108 at a proper height for play.

When tabletop 102 is in the storage position of FIG. 3, the tabletop's center of gravity sits proximate the longitudinal center of foot member 122 and midway halfway between columns 120A and 120B, for proper stability during upright storage of the table.

Second leg assembly 116 comprises another pair of upright support columns 128A and 128B, rigidly connected together by foot member 130. Both support columns and the foot member are similarly preferably made of hollow steel tubing, and may be made of one piece of tubing bent at each corner or it may be made of separate sections of tubing welded together at the corners.

Second leg assembly 116 is pivotally connected to the underside of tabletop 102 near to the tabletop's second end 110 by hinge pins 124B, allowing second leg assembly 116 to be pivoted relative to tabletop 102 from the leg's normal playing position shown in FIG. 1 to the leg's storage position shown in FIG. 3.

When tabletop 102 is in the playing position of FIG. 1, the second leg assembly 116 supports the tabletop's second end 110 at the aforementioned proper height for play, and cooperates with the first leg assembly 114 to ensure that the playing surface 104 is horizontal.

H-shaped rigid link member 132 comprises longitudinal beam 134 and pivot arms 136A and 136B, which are all preferably made of separate sections of hollow steel tubing welded together at the joints. Pivot arm 136A is pivotally connected at its terminal ends to columns 120A and 120B by hinge pins 138, and pivot arm 136B is pivotally connected at its terminal ends to columns 128A and 128B by hinge pins 138, which cooperate to allow simultaneous pivotal movement between link member 132 and both leg assemblies 114 and 116, and enable the tabletop to be pivoted upwardly from the playing to the storage position in a "collapsing parallelogram" manner which allows the second leg assembly 116 to remain substantially vertical and substantially parallel to first leg assembly 114 throughout conversion form the playing position to the storage position. As a result, rigid link member 132 serves to automatically pull second leg assembly 116 in towards the underside of tabletop 102 during the upward pivoting of the tabletop as it is lifted towards its storage position, and to pull the second leg assembly snuggly up against the underside of the table top and cause the table to reach its most compacted condition as it reaches the storage configuration. As can thus be appreciated, a user simply needs to lift the tabletop towards its storage configuration during conversion, without ever touching the second leg assembly.

Alternatively, as table 100 is returned to its normal playing state, rigid link member 132 serves to automatically push second leg assembly 116 out and away from the underside of tabletop 102 during the downward pivoting of the tabletop, to the aforementioned leg's normal playing position for supporting the tabletop in the aforementioned tabletop playing position. As can thus be appreciated, a user simply needs to push the tabletop down towards its playing configuration during conversion, without ever touching the second leg assembly.

Additional aspects of the invention lay in the means that hold tabletop 102 and leg assemblies 114 and 116 safely in either their storage or playing positions.

Figure 4A:
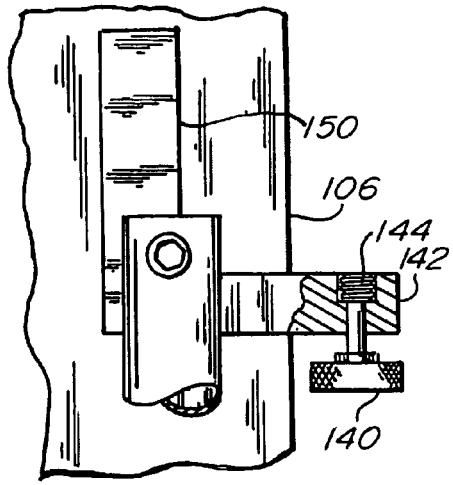
FIG. 4A is a partial sectional view showing one of the captured screws which affix the tabletop of the table of FIG 1 to its base, in its hanging state during storage.
Figure 4B:
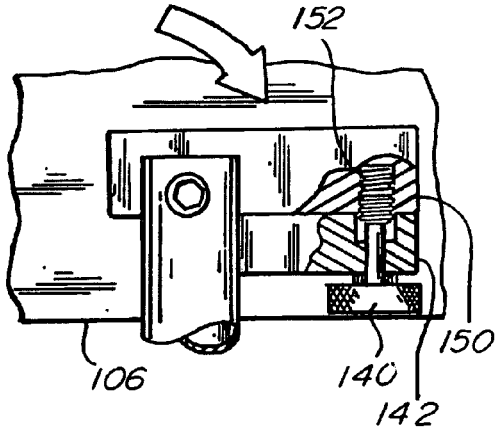
FIG. 4B is a partial sectional view showing the captured screw of FIG 4A in its fastened state during play.

Both of the first and second leg assemblies 114 and 116 are firmly and removably attached to tabletop 102 during the playing position of FIG. 1 by the captive screws 140 shown in FIGS. 4A and 4B, which is typical for the upper terminal end of each column 120A, 120B, 128A and 128B.

Leg tab 142 is affixed to and projects longitudinally and horizontally from the column and includes countersunk and threaded through-hole 144. Through-hole 144 is arranged to allow the male-threaded end of captive screw 140 to be rotated through the hole's lower female-threaded portion until the male-threaded end of the screw has passed freely into the countersunk portion of the hole. The screw is thus "captured" in the hole but free to rotate when the tabletop is in its storage position as shown in FIG. 4A, and is conveniently held available for use after the tabletop has been lowered into the playing position shown in FIG. 4B. A variety of common fastening arrangements, generically known as "captive screws", may be substituted to avoid having loose and separate fasteners that could be inadvertently misplaced during times of non-use.

Tabletop tab 150 is affixed to and projects inwardly and horizontally from the underside of peripheral wall 106 and includes threaded hole 152 which is aligned with through-hole 144 when the tabletop is in its playing position.

When tabletop 102 is lowered into its playing position as shown in FIG. 4B, leg tab 142 and tabletop tab 150 are brought together so that through-hole 144, screw 140, and threaded hole 152 are aligned and so that screw 140 may be tightened into threaded hole 152 to temporarily, but firmly, secure leg assemblies 114 and 116 to tabletop 102 and hold the table firmly and safely in its playing position.

Figure 5A:
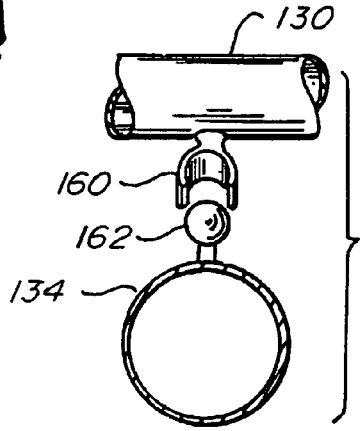
FIG. 5A is a partial view showing the holding clip of the base of the table of FIG 1 in its unfastened state.
Figure 5B:
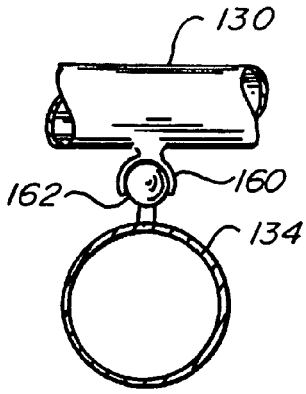
FIG. 5B is a partial view showing the holding clip of FIG 5A in its fastened state during storage.

Referring now to FIGS. 5A and 5B (taken at Line 5B-5B of FIG. 3), a novel fastening mechanism is shown for temporarily holding table 100 upright and safely in its storage position. Clip 160 is permanently affixed to the second leg assembly's foot member 130. The clip is preferably molded of a strong and resilient plastic material, but may alternatively be a metal spring-type clip or made of some other material having sufficient flexibility and strength.

Cylindrical rod 162 is permanently affixed to, such as by welding, the longitudinal beam 134 of rigid link member 132, and parallel therewith. The rod is disposed longitudinally at a position on the beam that causes it to be engaged by that clip 162 as shown in FIGS. 5A and 5B as the table approaches its storage position. Clip 162 snaps around and securely grasps rod 160 to hold the tabletop in its storage position, requiring an intentional and directed force of sufficient to disengage the clip and rod that ensures the table will not be allowed to inadvertently fall down towards the floor.

Figure 5C:
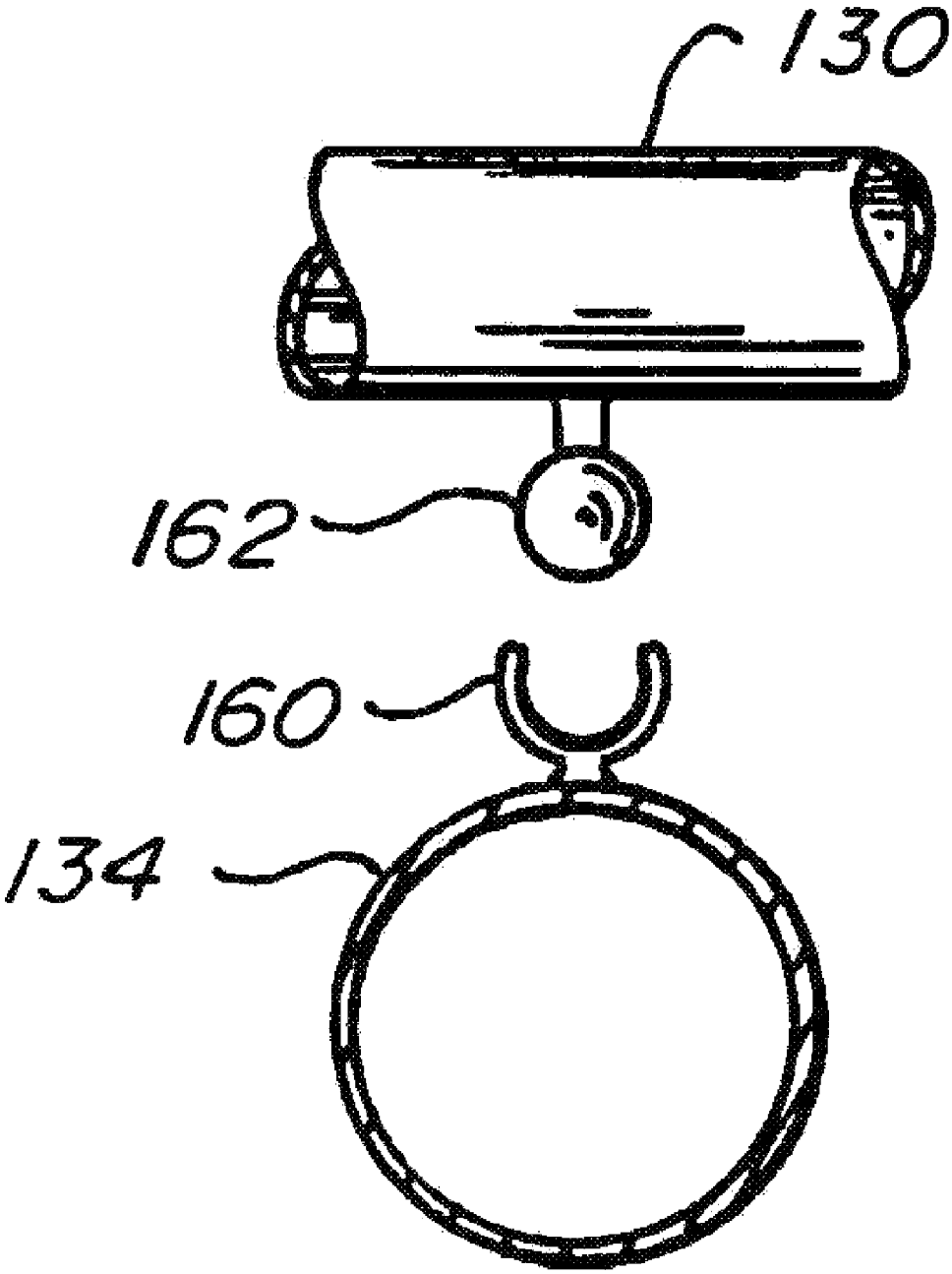
FIG. 5C is a partial view showing an alternate holding clip in its unfastened state.

Alternatively, clip 160 and rod 162 could be swapped so that the clip is permanently affixed to beam 132 and rod is permanently affixed to foot member 130, as shown in FIG. 5C.

As can be appreciated from the foregoing, the present invention offers a sturdy and simple means for converting a game table from a playing configuration that consumes much of a room's floor area into a storage configuration that consumes very little, while overcoming the identified drawbacks of the prior art. And the invention can be used in connection with game tables of various types. The foregoing teaches only the presently preferred of many possible variations of the invention, and it should therefore be understood that the scope of the invention should only be limited by the following claims.

I claim:

1. In a game table having a tabletop and a plurality of downwardly extending support legs, wherein the tabletop is pivotally connected to the legs and convertible thereby between a normally horizontal playing position and a vertical storage position wherein the legs are substantially coplanar with the tabletop and include feet, the improvements wherein;

a rigid link pivotally connects all of the legs and causes the legs to assume a disposition substantially coplanar with the table top as the table to is convened from its playing position to its storage position;

one or more of said support legs is a base leg comprising a horizontal crossbeam and feet for supporting the tabletop during both the playing and storage positions;

said rigid link comprises a beam pivotally connecting the one or more base legs to the remaining legs; and a coupling extending from and disposed at a substantially perpendicular intersection of said rigid link and said horizontal cross beam temporarily and removably affixes said rigid link to said horizontal cross beam during the storage position to prevent the tabletop from inadvertently falling into the playing position, said coupling comprising:

a first coupling portion affixed to one of said rigid link and said horizontal cross beam, and a second coupling portion affixed to the other of said rigid link and said horizontal cross beam.

2. In the game table of claim 1, the further improvement wherein one of said first and first and second coupling portions comprises a flexible clip permanently affixed to either of said rigid link or said horizontal cross beam and adapted to temporarily capture the other of said first and second coupling portions during the storage position.

3. In the game table of claim 2, the further improvement wherein said flexible clip is permanently affixed to said rigid link and is adapted to temporarily capture said second coupling portion during the storage position.

4. In the game table of claim 1, the further improvement wherein either the tabletop or one or more of the support legs comprises one or more fasteners adapted to temporarily affix said either to the other of said tabletop or the one or more of the support legs during the playing position.

5. In the game table of claim 4, the further improvement wherein the one or more of the support legs comprises said one or more fasteners.

6. In the game table of claim 5, the further improvement wherein said one or more fasteners comprises one or more captive screws.

7. A game table for use on a horizontal support surface and comprising;

a tabletop adapted for playing a game thereon and extending longitudinally from a first end to a second end opposite there-from, and a support structure for supporting said tabletop, said support structure comprising;

a first leg member comprising one or more first vertical columns with one or more feet rigidly connected thereto at a lower terminal end thereof, said one or more first vertical columns each being pivotally connected at an upper terminal end adjacent to said first end of said tabletop by a hinge;

said table top adapted to pivot about said hinge relative to said one or more first vertical columns between a horizontal tabletop playing position and an upwardly directed substantially vertical tabletop storage position;

said one or more first vertical columns being adapted to support said first end of said tabletop at a desired distance above the support surface when said tabletop is in said horizontal tabletop playing position;

said one or more feet horizontally disposed on and parallel to the support surface below said hinge and extending longitudinally outwardly there-from and thereby adapted to provide balance to said tabletop when said tabletop is in its substantially vertical tabletop storage position, said support structure further comprising;

a second leg member comprising a horizontal cross beam, and further comprising one or more second vertical columns each being pivotally connected at an upper terminal end adjacent to said second end of said tabletop by a second hinge;

said second leg member adapted to pivot about said second hinge relative to said tabletop between a leg playing position wherein said one or more second vertical columns is perpendicular to said tabletop and a leg storage position wherein said one or more second vertical columns is disposed adjacent and substantially parallel to said tabletop;

said one or more second vertical columns being adapted to support said second end of said table top at said desired distance above the support surface, when said second leg member is in said leg playing position and said tabletop is in said horizontal playing position;

said support structure further comprising a rigid link member hingedly connected between said first and second leg members, and adapted to cause said one or more second leg members to pivot from said leg playing position to said leg storage position when said tabletop is pivoted from said tabletop playing position to said tabletop storage position whereby during said tabletop storage position said first and second vertical columns are substantially vertically coplanar with said tabletop; and wherein;

said rigid link member comprises a longitudinally disposed beam adapted to remain parallel with the tabletop during both said tabletop playing and storage positions; and said rigid link member further comprises a coupling extending from and disposed at a substantially perpendicular intersection of said rigid link member and said horizontal cross beam temporarily and removably affixing said rigid link member to horizontal cross beam during the tabletop storage position to prevent the tabletop from inadvertently falling into said tabletop playing position, said coupling comprising:

a first coupling portion affixed to one of said rigid link member and said horizontal cross beam, and a second coupling portion affixed to the other of said rigid link member and said horizontal cross beam.

8. The game table of claim 7 wherein one of said first and second coupling portions comprises a flexible clip permanently affixed to either of said rigid link member or said horizontal cross beam and adapted to temporarily capture the other of said first and second coupling portions during said tabletop storage position.

9. The game table of claim 8 wherein said flexible clip is permanently affixed to said rigid link member and is adapted to temporarily capture said horizontal cross beam during said tabletop storage position.

10. The game table of claim 9 wherein either said tabletop or one or more of said first and second leg members comprises one or more fasteners adapted to temporarily affix said either to the other of said tabletop or said one or more of said first and second leg members during the playing position.

11. The game table of claim 10 wherein said one or more of said first and second leg members comprises said one or more fasteners.

12. The game table of claim 11 wherein said one or more fasteners comprises one or more captive screws.

13. A table comprising;

a tabletop comprising a playing surface configured and arranged when in a horizontal disposition for playing a game there-atop from the group including pool, air hockey, and table tennis;

a first support portion comprising a first pair of vertically disposed support legs joined by a first substantially horizontal cross-beam extending there-between;

both of said first pair of support legs extending vertically downwardly from a first end of said tabletop to a horizontal support surface for maintaining said first end above and spaced from the support surface, and each of said first pair of support legs having a top terminal end pivotally engaging said first end to allow relative movement between said tabletop and said first support portion between a playing position wherein said playing surface is horizontally disposed and a storage position wherein said table top is substantially vertically disposed;

a second support portion comprising a second pair of vertically disposed support legs joined by second and third substantially horizontal cross-beams;

each of said second pair of support legs extending from a second end of said tabletop opposite said first end, and having a top terminal end pivotally engaging said second end and allowing relative movement between said second support portion and said tabletop from a first position wherein said second pair of support legs extends perpendicular from said table top and a second position wherein said second pair of support legs is disposed against and substantially parallel to said tabletop;

a rigid link disposed substantially parallel to and below said tabletop and extending between and pivotally connecting said first and second horizontal cross-beams such that movement of said tabletop from said playing position to said storage position relative to said first support portion causes concurrent movement of said second support portion from said first position to said second position in a "collapsing parallelogram" manner;

wherein said third horizontal cross-beam becomes disposed against said rigid link at an intersection as said tabletop reaches said storage position and said second support portion reaches said second position; and wherein one of said rigid link and said third horizontal cross-beam comprises a first coupling portion extending from and disposed at said intersection and the other of said rigid link and said third horizontal cross-beam comprises a second coupling portion extending from and disposed at said intersection, and said first and second coupling portions cooperate to maintain said tabletop in said storage position against gravitational forces attempting to cause the tabletop back to the playing position.

* * * * *